US005359356A

United States Patent [19]

Ecklund

[11] Patent Number: 5,359,356

[45] Date of Patent: Oct. 25, 1994

[54] COLLAPSIBLE JET-INK CONTAINER ASSEMBLY AND METHOD

[76] Inventor: Joel E. Ecklund, 14 Gate 6½, Sausalito, Calif. 94966

[21] Appl. No.: 954,294

[22] Filed: Sep. 30, 1992

[51] Int. Cl.[5] ..... B41J 2/175

[52] U.S. Cl. ..... 347/86

[58] Field of Search ..... 346/1.1, 140 R; 222/336.5, 105, 326, 327, 107

[56] References Cited

U.S. PATENT DOCUMENTS

| | | | |
|---|---|---|---|
| 4,053,901 | 10/1977 | Skafvenstedt et al. | 346/140 R |
| 4,183,031 | 1/1980 | Kyser et al. | 346/140 R |
| 4,419,678 | 12/1983 | Kasugayama et al. | 346/140 R |
| 4,586,635 | 5/1986 | Collins, Jr. | 222/94 |

FOREIGN PATENT DOCUMENTS

| | | | |
|---|---|---|---|
| 0025848 | 2/1986 | Japan | 346/140 R |
| 0005855 | 1/1987 | Japan | 346/140 R |

OTHER PUBLICATIONS

Findlay, "Printer Ink Supply System", Aug. 1973, p IBM Technical Disclosure Bulletin, vol. 16, No. 3, pp. 796–798.

*Primary Examiner*—Benjamin R. Fuller
*Assistant Examiner*—N. Le
*Attorney, Agent, or Firm*—Flehr, Hohbach, Test, Albritton & Herbert

[57] ABSTRACT

A collapsible ink container assembly (30) for mounting to a piercing barb assembly (62) of an jet ink printer apparatus (74). The ink container assembly (30) comprises a flexible bladder (32) having a perimetric edge portion (34) which defines a distensible opening (36) to an interior portion (42). A substantially rigid wafer member (44) is provided which includes a needle receiving port (46) and an outwardly facing perimeter wall (48). The wafer (44) is positioned in the opening (36) such that the perimeter wall (48) distends the flexible bladder (32) to an open position (30). The edge portion (34) is coupled to the wafer (44) in a manner providing a first hermetic seal (49). A frangible membrane (50) cooperates with the receiving port (46) in a manner providing a second hermetic seal. The first seal (49) and the second seal cooperating to form an impervious seal to retain ink deposited in the interior portion (42) of the flexible bladder (32) from an exterior thereof. A method for constructing ink container cartridge for a printer apparatus is also provided.

21 Claims, 3 Drawing Sheets

COLLAPSIBLE JET-INK CONTAINER ASSEMBLY AND METHOD

TECHNICAL FIELD

The present invention relates, generally, to ink container assemblies and, more particularly, relates to collapsible ink container assemblies for ink jet printers.

BACKGROUND ART

Typically, ink jet printers draw ink from substantially rigid disposable cartridge-type ink containers having collapsible inner sealed bags which provide a reservoir of ink. As shown in FIG. 1, a disposable ink container 10 is inverted and positioned over a piercing barb assembly 11, having an upstanding needle 12, of an ink-jet style printer 27. When ink container 10 is manually urged toward barb assembly 11, needle 12 pierces a frangible grommet 13 to access the reservoir of ink. During use, a slidable primer rod 14 including a plunger 28 gravitationally assists ink bag collapse which facilitates movement of ink toward needle 12 and reduces ink starvation (FIG. 2).

FIG. 1 illustrates that disposable ink container 10 includes a rigid cylindrical cup member 15 having a circumferential lip portion 16 which defines a cup opening 18. An ink retaining bag 17, having an open edge portion 19 defining bag opening 20, is received in a cup recess 21 in an orientation such that bag opening 20 coincides with cup opening 18. Open edge portion 19 of bag 17 is distended to an open position by folding the flexible walls of bag 17 over the circumferentially extending lip portion 16.

Subsequently, once cup member 15 is oriented in a manner such that cup opening 18 and bag opening 20 are facing upwardly, jet ink is deposited into bag interior portion 22 to retain ink therein and form ink reservoir 23. A thin substantially rigid washer 24 is then seated over lip portion 16, having the folded over bag walls therebetween, to cover bag opening 20. As shown in FIGS. 1 and 2, the bag walls are pinched between lip portion 16 and the snap-fit container cap 25 proximate open edge portion 19 to enhance sealing. Rigid washer 24 includes a centrally positioned aperture 26 which provides a passageway to access stored ink reservoir 23. A comparatively thick grommet washer 13 is sandwiched between a snap-fit container cap 25 and rigid washer 24 which cooperate to seal bag interior portion 22 from the environment. A needle receiving slot 29 is provided in container cap 25 which is aligned with needle receiving aperture 26 of washer 24. Container cap 25 is formed and dimensioned to lockably snap on to and mate with lip portion 16 of cup member 15 to not only hermetically seal bag opening 20, but washer aperture 26 as well. Hence, cap 25 must induce sufficient sealing pressure against both rigid washer 24 and grommet 13 to prevent leakage. Further, container cap 25 must sufficiently grip lip portion 16 so as not to inadvertently separate and so that the flexible bag wall provides an adequate gasket therebetween.

While these assemblies have been adequate to supply and store jet-ink, several problems are inherent with these configurations. For example, fabrication has proven rather tedious, time consuming and costly. In addition, leakage of ink from retaining bag 17 is frequent as container cap 25 often does not properly mate with lip portion 16. As a result, the seal integrity is compromised and is no longer impervious. Further, because of the snap-fit nature of container cap 25, the gasket-type seal provided by the flexible bag 17 is often breached so that leakage occurs around the joints thereof. Moreover, once the ink reservoir is depleted, the whole container 10 is disposed of which constitutes an enormous material waste. Finally, to access ink reservoir 23, needle 12 must pierce through frangible grommet 13 at a location directly adjacent washer aperture 26, which cannot be seen. Accordingly, needle 12 can be damaged when alignment is improper and needle 12 is forced against rigid washer 24.

DISCLOSURE OF INVENTION

Accordingly, it is an object of the present invention to provide an jet-ink container assembly and method which provides a disposable reservoir of ink for an ink jet printer.

Another object of the present invention to provide an jet-ink container assembly and method which reduces construction complexity.

Still another object of the present invention is to provide an jet-ink container assembly and method which reduces ink container leakage.

Yet another object of the present invention is to provide an jet-ink container assembly and method which is more cost effective to manufacture.

It is another object of the present invention to provide an jet-ink container assembly and method which can be retrofit to most ink-jet style printers.

Another object of the present invention to provide an jet-ink container assembly and method which reduces damage to printer components caused by mounting the ink container assembly to the printer.

It is a further object of the present invention to provide an jet-ink container assembly and method which is durable, compact, easy to maintain, has a minimum number of components, and is easy to use by unskilled personnel.

In accordance with the foregoing objects, the invention includes a collapsible ink container assembly for mounting to a piercing barb assembly of an jet ink printer apparatus. The barb assembly includes a needle formed to cooperate with the ink container assembly to draw jet ink therefrom. The ink container assembly comprises a flexible sleeve having a first edge portion defining a first distensible opening, an opposite second edge defining a second distensible opening, and an interior portion therebetween. A substantially rigid wafer member is provided which includes a needle receiving port and an outwardly facing perimeter wall. The wafer is positioned in the first distensible opening such that said perimeter wall distends the sleeve at the first edge portion to an open position. The first edge portion is further hermetically sealed to the perimeter of the wafer. A frangible membrane cooperates with said receiving port in a manner providing a second hermetic seal.

In another aspect of the present invention, a method of constructing a ink container cartridge assembly for a printer apparatus is provided, briefly, comprising the steps of: placing the flexible sleeve over an elongated anvil such that the first edge portion extends beyond the distal end of the anvil; inserting a rigid wafer member into the first distensible opening until the wafer seats against the anvil distal end; moving the sleeve along the anvil until the first edge portion is positioned proximate the outer perimeter wall such that the outer perimeter wall distends the sleeve proximate the first edge portion to an open position. The method further includes hermetically sealing an inner perimeter wall of the sleeve member, proximate the first edge portion, to the wafer proximate the outer perimeter wall to form a first hermetic seal; receiving a frangible membrane in the receiving port, the membrane cooperating with the port in a manner providing a second hermetic seal; depositing a predetermined amount of ink into the interior portion of sleeve through the second opening. Finally, closing the second opening proximate the second edge portion in a manner providing a third hermetic seal. The first, second and third seal cooperating to hermetically seal ink deposited in the interior portion of the sleeve from an exterior thereof.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
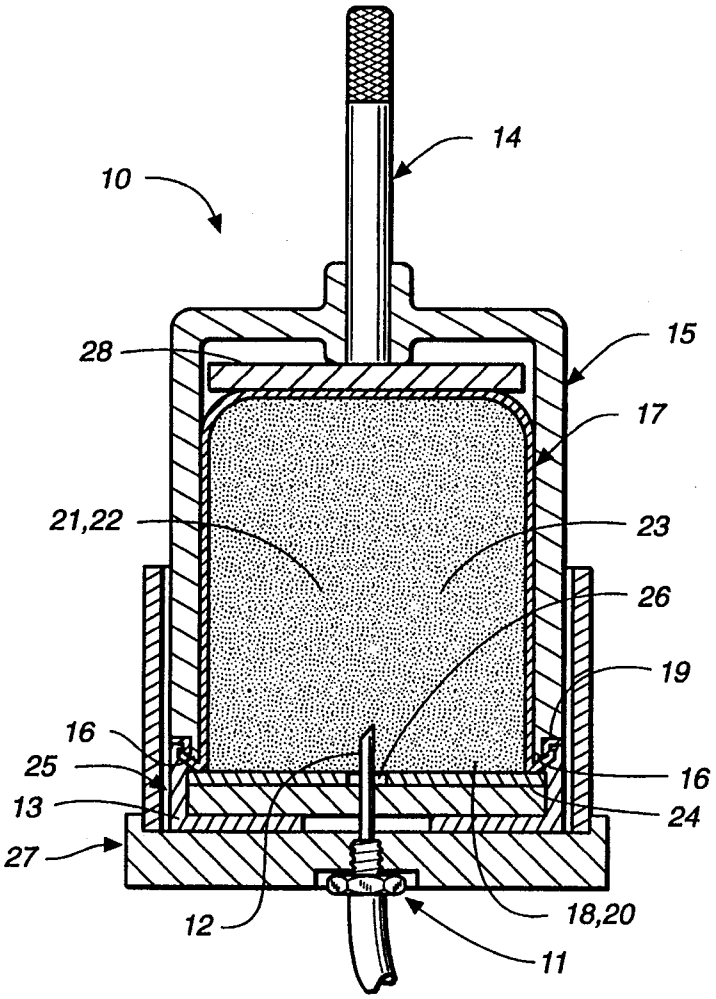
FIG. 1 (PRIOR ART)
FIG. 1 is a side elevation view, in cross-section, of a prior art disposable jet ink container assembly mounted to a piercing barb apparatus.
Figure 2:
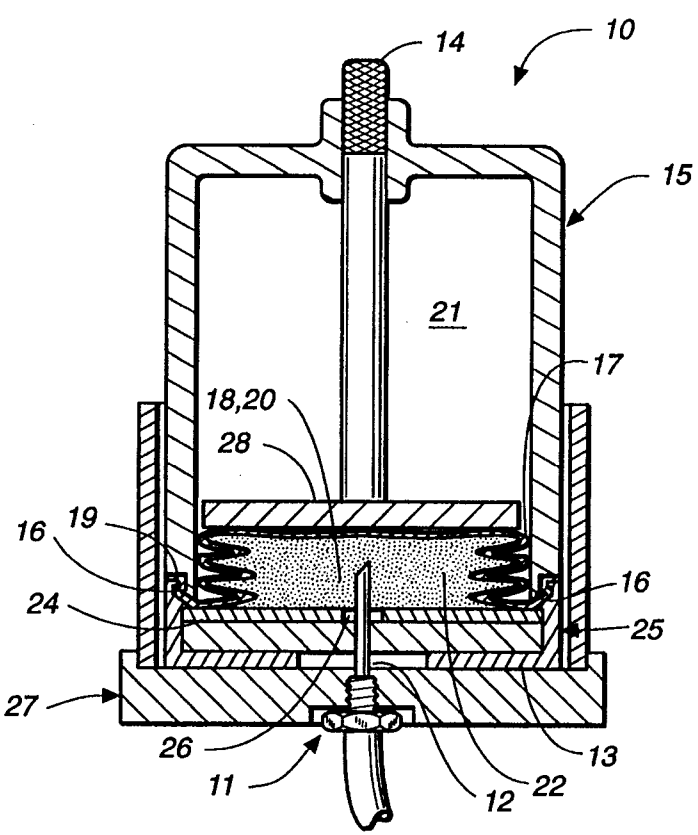
FIG. 2 (PRIOR ART)
FIG. 2 is a side elevation view of the prior art assembly of FIG. 1 illustrating collapse of the inner sealed ink bag during usage.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 3:
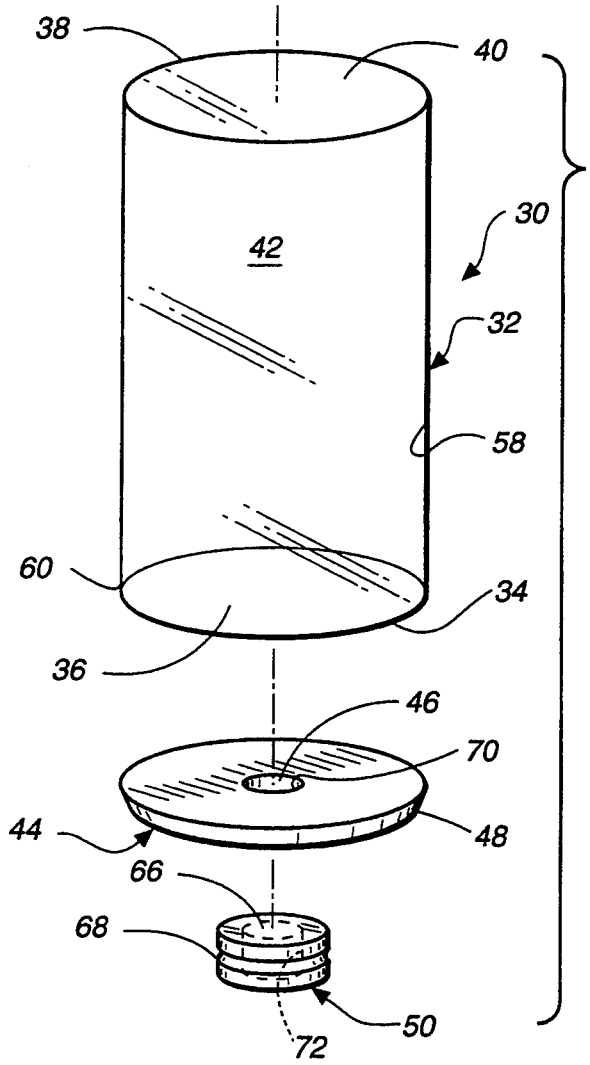
FIG. 3 is an exploded, side elevation view of a collapsible jet ink container constructed in accordance with the present invention.
Figure 4:
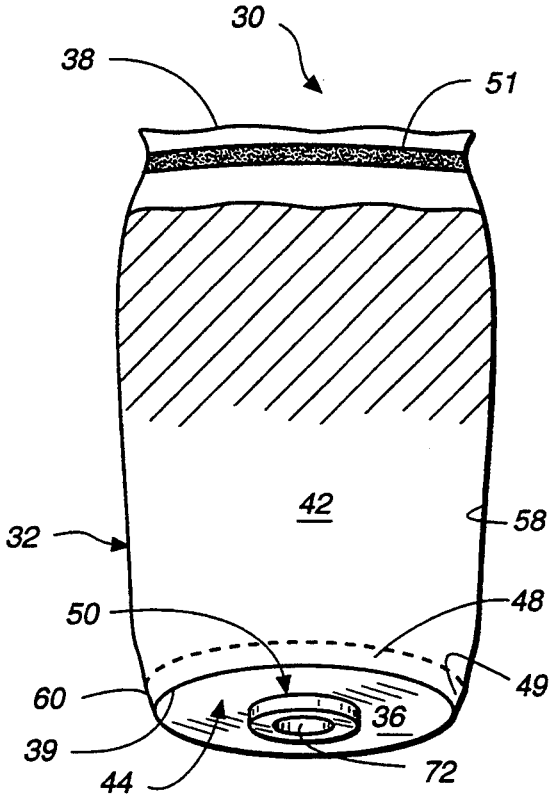
FIG. 4 is a bottom perspective view of the jet ink container of FIG. 3.
Figure 5:
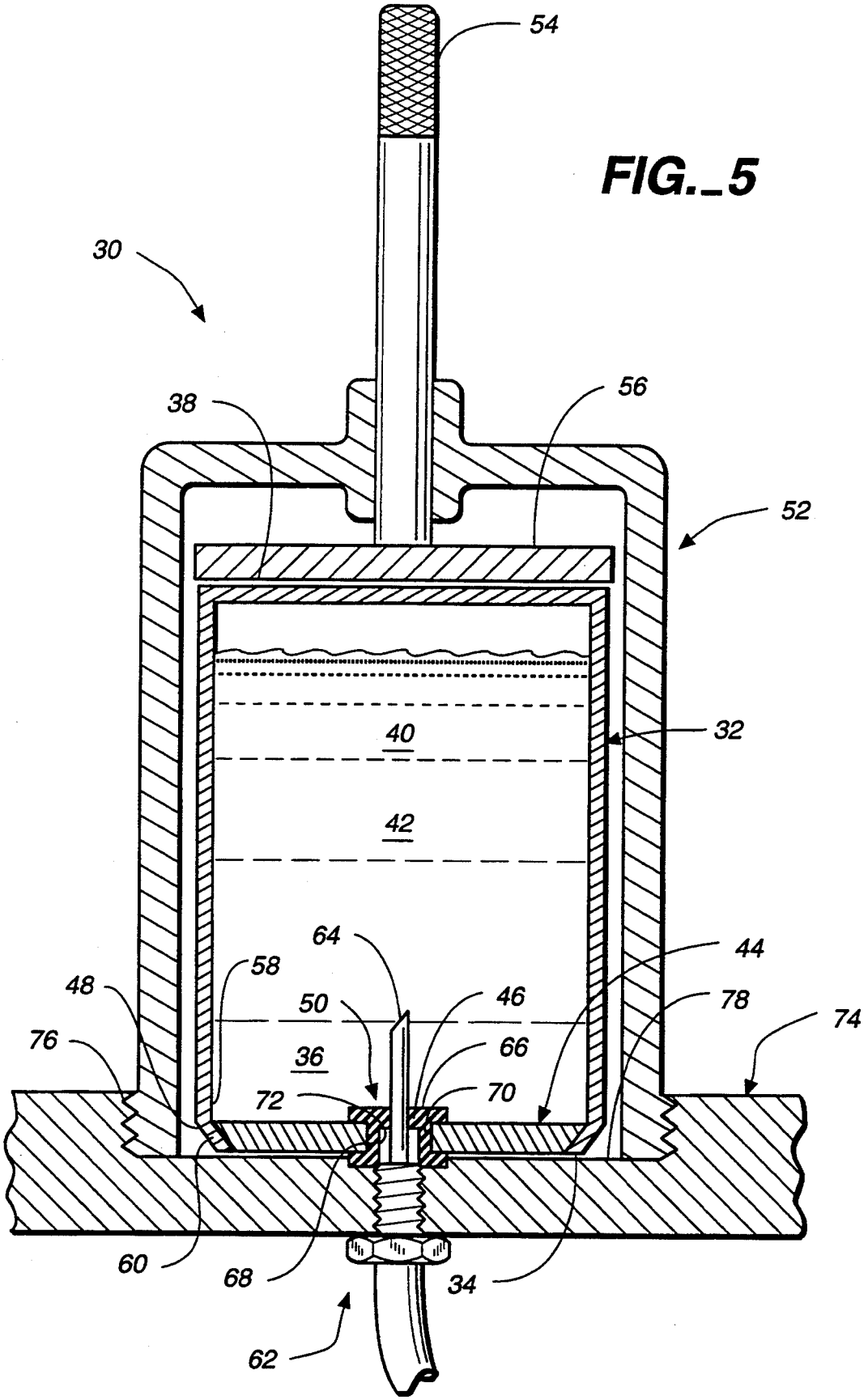
FIG. 5 is a side elevation view, in cross-section, of the jet ink container of FIG. 3 and showing mounting to a piercing barb assembly of an ink-jet style printer.

Attention is now directed to FIG. 3 where the collapsible ink container assembly, generally designated 30, of the present invention is shown in an exploded view. Briefly, collapsible ink container assembly 30 comprises flexible sleeve means, generally designated 32, having a first edge 34 which defines a first distensible opening 36. Sleeve means 32 further provides an opposite second edge 38 which defines a second distensible opening 40, and an interior portion 42 positioned between first opening 36 and second opening 40. A substantially rigid wafer member, generally designated 44, includes a needle receiving port 46 and an outwardly facing perimeter wall 48. Wafer member 44 is positioned in first opening 36 such that perimeter wall 48 distends sleeve means 32 proximate first edge 34 to an open position. First edge 34 is coupled to wafer member 44 proximate perimeter wall 48 in a manner providing a first hermetic seal 49 (FIGS. 4 and 5). A frangible membrane, generally designated 50, cooperates with receiving port 46 in a manner providing a second hermetic seal. Oppositely facing second opening 40, hence, can be distended so that ink can be deposited into interior portion 42. Subsequently, second opening 40 is hermetically sealed 51 causing the ink reservoir contained therein to be impervious to external influences.

In accordance with the present invention, a disposable, flexible ink container insert is formed which is simple to assemble and can be manufactured from a small number of parts. As compared with the prior art jet-ink containers, this represents a considerable reduction. Accordingly, disposal of assembly 30 minimizes waste since cup member 52, slidable primer rod 54 and plunger 56 are all reusable (FIG. 5).

As viewed in FIG. 3, a simple flexible sleeve member 32 is provided which is formed of a substantially nonpermeable material so that jet-ink can be stored and retained therein. In the preferred form, sleeve means 32 is composed of a deformable plastic material, such as polyethylene or the like, having a thickness of about 0.004 inches. Further, sleeve means 32 may be provided by a prefabricated "tube stock" cylindrical shell having an inner diameter of about 1.305 inches. Depending on the application, however, these dimensions may vary considerably without departing from the true spirit and scope of the present invention.

Wafer member 44 is formed to cooperate with sleeve means 32 to close off and seal first opening 36. Hence, wafer member 44 is inserted into first opening 36 and aligned so that the perimeter wall 48 of wafer 44 contacts the inner facing walls 58 of cylindrical sleeve means 32 proximate first opening 36. Wafer member 44, thus, acts against sleeve inner walls 58 to distend first edge 34 toward the open position. As will be described in greater detail below, inner facing walls 58 are mounted to wafer member 44 proximate perimeter wall 48 in a manner causing an impervious seal therebetween. To best execute this feature, inner facing walls 58 are mounted directly to perimeter wall 48 at first edge 34. Accordingly, it is advantageous that perimeter wall 48 be a smooth curvilinear surface to facilitate sealing.

As best shown in FIG. 3, wafer member 44 is provided by a solid flat circular disc member having an outer diameter substantially similar to the inner diameter of sleeve means 32 (e.g., 1.305 inches). Further, wafer member 44 must be of a thickness sufficient to provide rigidity and stability to container assembly 30 when membrane 50 is pierced by needle 64 (FIG. 5). Wafer member 44, thus, is preferably at least about $\frac{1}{8}$ inch thick and is composed of a material similar to sleeve means 32.

Further, in the preferred form, the perimeter edge of wafer member 44 is chamfered inwardly in a direction away from interior portion 42 of sleeve 32. Hence, perimeter wall 48 forms a conical section having an apex positioned distally away from first opening 36. Preferably, the inclination of perimeter wall 48 is about 20° relative to a substantially vertical axis. It will be understood, however, that the inclination may vary. As best shown in FIG. 5 and as to be discussed in length henceforth, the inward inclination of perimeter wall 48 facilitates hermetic sealing to sleeve inner walls 58.

Figure 6:
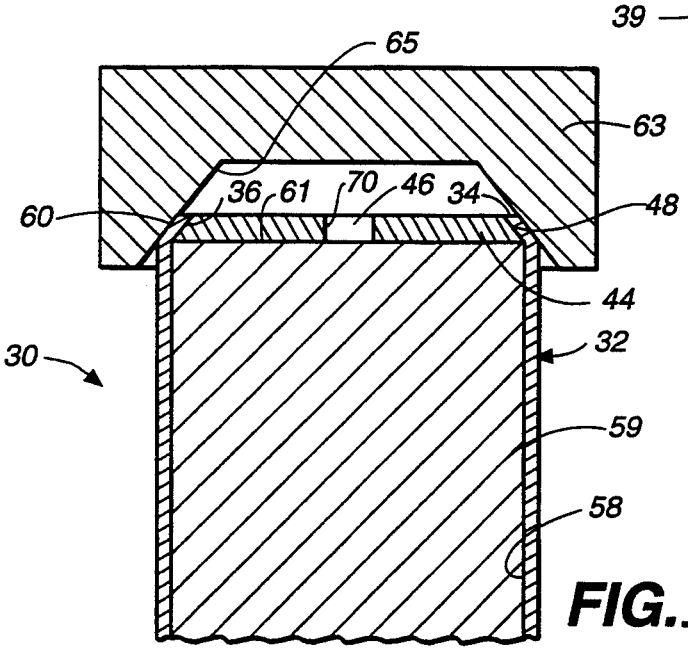
FIG. 6 is a fragmentary, side elevation view, in cross-section, of the jet ink container of FIG. 3 mounted to an anvil for heat sealing in a heated cavity of a heated head.

To fabricate ink container assembly 30, an upward extending anvil or mandrel is shown in FIG. 6 having a diameter substantially similar to the inner diameter of sleeve means 32 is inserted through second opening 40 until the distal end 61 of the mandrel is positioned proximate the interior portion of sleeve means 32. Wafer member 44 is positioned into sleeve means 32 in an orientation where the inward inclination of perimeter wall 48 faces away from interior portion 42 and from the distal end of the mandrel. Once wafer member 44 is seated against the distal end of the mandrel, sleeve means 32 is slide further along the mandrel until first edge 34 is positioned preferably flush with, but not past, perimeter wall 48 so sleeve inner walls 58 are always in contact therewith.

To provide a hermetic seal therebetween, sleeve inner wall 58 and wafer perimeter wall 48 are welded together. Although an appreciable number of sealing methods may be employed, such as adhesives, heat welding has been found to be quick and reliable.

When sleeve 32 and wafer 44 are supported by the mandrel, as above-indicated, a heated head 65 as shown in FIG. 6 providing a conical heated cavity 65 cooperates with the mandrel to weld sleeve 32 and wafer 44 together. The conical cavity includes an inward inclination substantially similar to the inward inclination of wafer perimeter wall 48 for mating engagement. The conical cavity is sufficiently urged against outer surface 60 of sleeve means 32, and heated to a predetermined degree to cause sleeve inner wall 58 to weld to wafer perimeter wall 48 proximate first edge 34. Accordingly, this configuration provides the necessary components to form a reliable hermetic seal 49 between wafer member 44 and sleeve means 32 without damaging the remaining portions of container assembly 30.

Moreover, it will be understood that once wafer member 44 is mounted to sleeve inner wall 58, wafer perimeter wall 48 distends first edge 34 of sleeve means 32 to an open position which defines first opening 36.

FIG. 3 illustrates that wafer member 44 provides a needle receiving port 46 formed to permit a needle (FIG. 5) to pass therethrough upon mounting to barb assembly 62. Port 46 is preferably centrally disposed and of a substantially smaller inner diameter compared to the outer diameter of wafer 44.

Frangible membrane 50 is formed to cooperate with needle receiving port 46 in a manner forming the second hermetic seal therewith to fully seal first opening 36. Membrane 50 must be substantially resilient so that when needle 64 (FIG. 5) pierces membrane 50, to access the ink stored reservoir, membrane 50 will sufficiently grip the outer side surface of needle 64 to prevent leakage. In the preferred embodiment, frangible membrane 50 is provided by a sealed rubber grommet or bung, as viewed in FIG. 3, having a sealed end portion 66 (FIG. 4) and an annular groove 68 circumferentially extending around a midportion thereof. Groove 68 is formed and dimensioned to receive the inner port edge 70, as best viewed in FIG. 5, defining needle receiving port 46 to provide the second hermetic seal therewith.

The outer diameter of annular groove 68 is larger than the inner diameter of port edge 70 of receiving port 46 so that upon insertion of grommet 50 into port 46, a substantially impervious seal is formed between annular groove 68 and port edge 70. Further, grommet 50 provides a bore 72 in the interior surface thereof in order to facilitate piercing by needle 64. Accordingly, only thin skin end portion 66 facing interior portion 42 need be pierced by needle 64 when mounted to printer assembly 30.

In accordance with the present invention, once first opening 36 of sleeve means 32 has been properly sealed by wafer member 44 and grommet 50, container assembly 30 is placed in an orientation where second opening 40 is facing upwardly. Ink can then be deposited in the interior portion 42 of container assembly 30 to form the ink reserve. Second opening 40 is then sealed proximate second edge 38 in a manner forming a third hermetic seal 51 which fully encloses interior portion 42 from the exterior.

Sealing of second opening 40 is preferably accomplished by heat sealing. Second edges 38 are pinched together so that the opposing sleeve inner wall sides 58, proximate second edge 38, abut one another. A second heat sealer (not shown) hermetically seals or crimps second opening closed. It will be appreciated, however, that other sealing processes, such as adhesives, may be employed without departing from the true spirit and nature of the present invention.

Although the present invention has thus been described having two distinct open ends (i.e., first opening 36 and second opening 40) provided by sleeve means 32, it will be understood that container assembly 30 could include a container bladder having only one opening upon which wafer member 44 distends and is mounted thereto. In this embodiment, however, the ink would have to be deposited into the interior portion through the first opening.

To mount container assembly 30 to barb assembly 62 of printer 74, as viewed in FIG. 5, container assembly 30 is oriented relative printer 74 so that wafer member 44 faces barb assembly 62. Grommet 50, and particularly bore 72, are aligned with piercing needle 64 before needle 64 is thrust through skin 66 of grommet 50. Container assembly 30 is slide all the way along needle 64 until grommet 50 and/or wafer 44 contacts the surface of printer 74. Resilient skin 66 of grommet 50 continues to sufficiently grip needle 64 to prevent leakage.

In another aspect of the present invention, a reusable cup member 52 is provided which includes primer rod 54 and plunger 56 slidably mounted thereto. Once, container assembly 30 is properly mounted to printer 74 for use, cup member 52 is inverted and placed over container assembly 30 so that plunger 56 contacts sealed second edge 38. Cup member 52 is then stably mounted to printer 74 by any releasable mounting means such as a sliding locking mechanism (not shown). In another embodiment, FIG. 5 illustrates that cup member 52 includes a threaded end 76 formed and dimensioned to cooperate with a threaded recess 78 provided in the surface of printer 74 to releasably mount thereto.

Accordingly, once the ink reservoir is depleted, cup member 52 may be removed to discard and replace ink container assembly 30. Subsequently, cup member 52, primer rod 54 and plunger 56 may be remounted and reused which results in a formidable material savings in comparison to the prior art jet-ink containers.

In another aspect of the present invention, a method of constructing ink container assembly 30 is provided comprising the steps of: placing flexible sleeve 32 over an elongated anvil 59 (FIG. 6) such that first edge portion 34 extends beyond the distal end 61 of the anvil; inserting rigid wafer member 44 into first distensible opening 36 until wafer member 44 seats against the anvil distal end. In addition, moving sleeve 32 along the anvil until first edge portion 34 is positioned proximate wafer outer perimeter wall 48 such that outer perimeter wall 48 distends sleeve 32 proximate first edge portion 34 to an open position. The method further includes hermetically sealing an inner perimeter wall 58 of sleeve member 32, proximate first edge portion 34, to wafer member 44 proximate outer perimeter wall 48 to form first hermetic seal 49; receiving frangible membrane 50 in receiving port 46, frangible membrane 50 cooperating with receiving port 46 in a manner providing second hermetic seal. The next step includes depositing a predetermined amount of ink into interior portion 42 of sleeve 32 through second opening 40. Finally, closing second opening 40 proximate second edge portion 38 in a manner providing third hermetic seal 51. The first, second and third seal cooperate to hermetically seal ink deposited in interior portion 42 of sleeve 32.

What is claimed is:

1. A collapsible ink container assembly for mounting to a piercing barb assembly of an jet ink printer apparatus, said barb assembly having a needle formed to cooperate with said ink container assembly to draw jet ink therefrom, said ink container assembly comprising:

flexible sleeve member having a first edge portion defining a first distensible opening, an opposite second edge portion defining a second distensible opening, and an interior portion therebetween;

a substantially rigid wafer member having a needle receiving port and an outwardly facing perimeter wall defining a conical portion having an apex positioned distally away from said first distensible opening, said wafer is positioned in said first distensible opening such that said perimeter wall distends said sleeve member at said first edge portion to an open position, and said first edge portion is hermetically sealed to said perimeter wall at said conical portion of said wafer to form a first hermetic seal; and a frangible membrane cooperating with said receiving port to provide a second hermetic seal.

2. The collapsible ink container assembly as defined in claim 1 wherein, said second opening is sealed proximate to said second edge portion in a manner providing a third hermetic seal, and said first seal, said second seal and said third seal cooperate to hermetically seal said ink deposited in said interior portion of said sleeve member.

3. The collapsible ink container assembly as defined in claim 2 wherein, said frangible membrane comprises a rubber grommet formed and dimensioned to be positioned in and hermetically seal said port.

4. The collapsible ink container assembly as defined in claim 2 wherein, said first hermetic seal is provide by heat welding said perimeter wall and said first edge portion together.

5. The collapsible ink container assembly as defined in claim 2 wherein, said wafer and said sleeve member are composed of polyethylene.

6. The collapsible ink container assembly as defined in claim 2 wherein, said wafer comprises a circular disc.

7. The collapsible ink container assembly as defined in claim 2 wherein, said wafer is about 1-5/16" in diameter.

8. The collapsible ink container assembly as defined in claim 2 wherein, said third hermetic seal is provided by heat sealing.

9. The collapsible ink container assembly as defined in claim 2 wherein, said interior portion contains said ink therein.

10. The collapsible ink container assembly as defined in claim 1 wherein, an inclination of said conical section is about 20°.

11. A collapsible ink container assembly for mounting to a piercing barb assembly of an jet ink printer apparatus, said barb assembly having a needle formed to cooperate with said ink container assembly to draw jet ink therefrom, said ink container assembly comprising:

flexible bladder member having a perimetric edge portion defining a distensible opening and an interior portion formed to retain said ink therein;

a substantially rigid wafer member having a needle receiving port and an outwardly facing perimeter wall defining a conical portion having an apex positioned distally away from said distensible opening, positioned in said distensible opening such that said perimeter wall distends said bladder member proximate to said edge portion to an open position, and said edge portion is hermetically sealed to said perimeter wall at said conical portion of said wafer to form a first hermetic seal; and a frangible membrane cooperating with said receiving port to provide a second hermetic seal, and said first seal and said second seal cooperates to hermetically seal ink deposited in said interior portion of said bladder member.

12. The collapsible ink container assembly as defined in claim 11 wherein, said frangible membrane comprises a rubber grommet formed and dimensioned to be positioned in and hermetically seal said port.

13. The collapsible ink container assembly as defined in claim 11 wherein, an inclination of said conical section is about 20°.

14. The collapsible ink container assembly as defined in claim 11 wherein, said first hermetic seal is provide by heat welding said perimeter wall and said first edge portion together.

15. The collapsible ink container assembly as defined in claim 11 wherein, said bladder means comprises a polyethylene bag, and said wafer member comprises a polyethylene disc.

16. A method of constructing an ink container cartridge assembly for a printing apparatus comprising the steps of:

inserting a substantially rigid wafer member into a first distensible opening of a flexible sleeve member having a first edge portion defining said first distensible opening, said wafer member having a needle receiving port and an outwardly facing perimeter wall defining a conical portion having an apex positioned distally away from said distensible opening into said first distensible opening until said wafer seats against said anvil distal end;

hermetically sealing an inner perimeter wall of said sleeve member, proximate said first edge portion, to said outwardly facing perimeter wall of said wafer to form a first hermetic seal;

receiving a frangible membrane in said receiving port, said membrane cooperating with said port to provide a second hermetic seal;

depositing a predetermined amount of ink into an interior portion of said sleeve member through a second distensible opening defined by a second edge portion of said sleeve member opposite said first edge portion; and closing said second opening proximate said second edge portion to provide a third hermetic seal, said first seal, said second seal and said third seal cooperating to hermetically seal said ink deposited in said interior portion of said sleeve member.

17. The method of constructing an ink container cartridge assembly as defined in claim 16 wherein, said closing step is accomplished by heat sealing together opposing sleeve inner perimeter walls proximate said second edge portion.

18. The method of constructing an ink container cartridge assembly as defined in claim 18 further including the step of:

before said inserting step, placing said flexible sleeve member over an elongated anvil such that said first edge portion extends beyond a distal end of said anvil; and said inserting step further including inserting said wafer member into said first distensible opening until said wafer seats against said anvil distal end

19. The method of constructing an ink container cartridge assembly as defined in claim 18 wherein, said hermetic sealing of said sleeve inner perimeter wall to said wafer outwardly facing perimeter wall step is accomplished by heat welding said sleeve inner perimeter wall to said wafer outwardly facing perimeter wall.

20. The method of constructing an ink container cartridge assembly as defined in claim 19 wherein, said heat welding is accomplished by inserting said anvil distal end into a heated cavity defined in a heated head device, said cavity being formed and dimensioned for receipt of said anvil distal end; and forcing said inner sleeve perimeter wall into heated contact with said wafer outwardly facing perimeter wall until the same are heat welded together.

21. The method of constructing an ink container cartridge assembly as defined in claim 19 further comprises the step of:

moving said sleeve member longitudinally along said anvil until said first edge is positioned proximate said wafer outwardly facing perimeter wall such that said outwardly facing perimeter wall distends said sleeve means at said first edge portion to an open position.

* * * * *

UNITED STATES PATENT AND TRADEMARK OFFICE

CERTIFICATE OF CORRECTION

PATENT NO. :5,359,356

DATED :October 25, 1994

INVENTOR(S) :Joel E. Ecklund

It is certified that error appears in the above-indentified patent and that said Letters Patent is hereby corrected as shown below:

Column 5, line 4, after "mandrel" insert --59--.
Column 5, line 24, after "head" insert --65--and delete "as" in second occurrence and insert therefor -- is--.
Column 8, Claim 11, line 22, after "opening," and before "positioned" insert --said wafer is--.
Column 8, Claim 16, lines 60 and 61, after " distensible opening" in line 59, delete "into said first distensible opening until said wafer seats against said anvil distal end".

Signed and Sealed this

Third Day of January, 1995

Bruce Lehman

*Attest:*

BRUCE LEHMAN

*Attesting Officer*

*Commissioner of Patents and Trademarks*